United States Patent [19]

Laky

[11] 4,227,678

[45] Oct. 14, 1980

[54] CABLE TENSIONING DEVICE

[75] Inventor: Elmer Laky, Cranford, N.J.

[73] Assignee: Breeze Corporations, Inc., Union, N.J.

[21] Appl. No.: 969,987

[22] Filed: Dec. 15, 1978

[51] Int. Cl.[3] ..... B66D 1/76

[52] U.S. Cl. ..... 254/391; 242/67.2

[58] Field of Search ..... 254/175.7, 175.5, 138, 254/150 R, 190 R, 186 R; 242/75.2, 67.2, 207, 182; 226/195, 102, 39

[56] References Cited

U.S. PATENT DOCUMENTS

| | | | |
|---|---|---|---|
| 1,986,776 | 1/1935 | Moore | 242/75.2 |
| 2,280,727 | 4/1942 | Stechbart | 242/207 |
| 2,675,187 | 4/1954 | Childress | 242/67.2 |
| 2,776,096 | 1/1957 | Isbell | 254/175.7 |
| 2,872,130 | 2/1959 | Nardone | 242/158.2 |
| 2,947,516 | 8/1960 | Jackson | 254/175.7 |
| 3,071,332 | 1/1963 | Dain et al. | 242/182 |
| 3,110,451 | 11/1963 | Ikuro Monita | 242/67.2 |

*Primary Examiner*—Robert J. Spar
*Assistant Examiner*—Kenneth Noland
*Attorney, Agent, or Firm*—Albert F. Kronman

[57] ABSTRACT

A tensioning device for the cable of a winch or hoist transmits rotational power from the drum, on which the cable is wound through a gear train to a traction roller which rubs against the cable as it passes into and out of the hoist. The gears rotate the traction roller in the same direction in which the cable is moving but at a speed which will always keep the cable under tension on the drum. Two overrunning clutches in the gear train transmit the rotary motion of the drum to the traction reel in either the cable payout or reel in operation.

6 Claims, 2 Drawing Figures

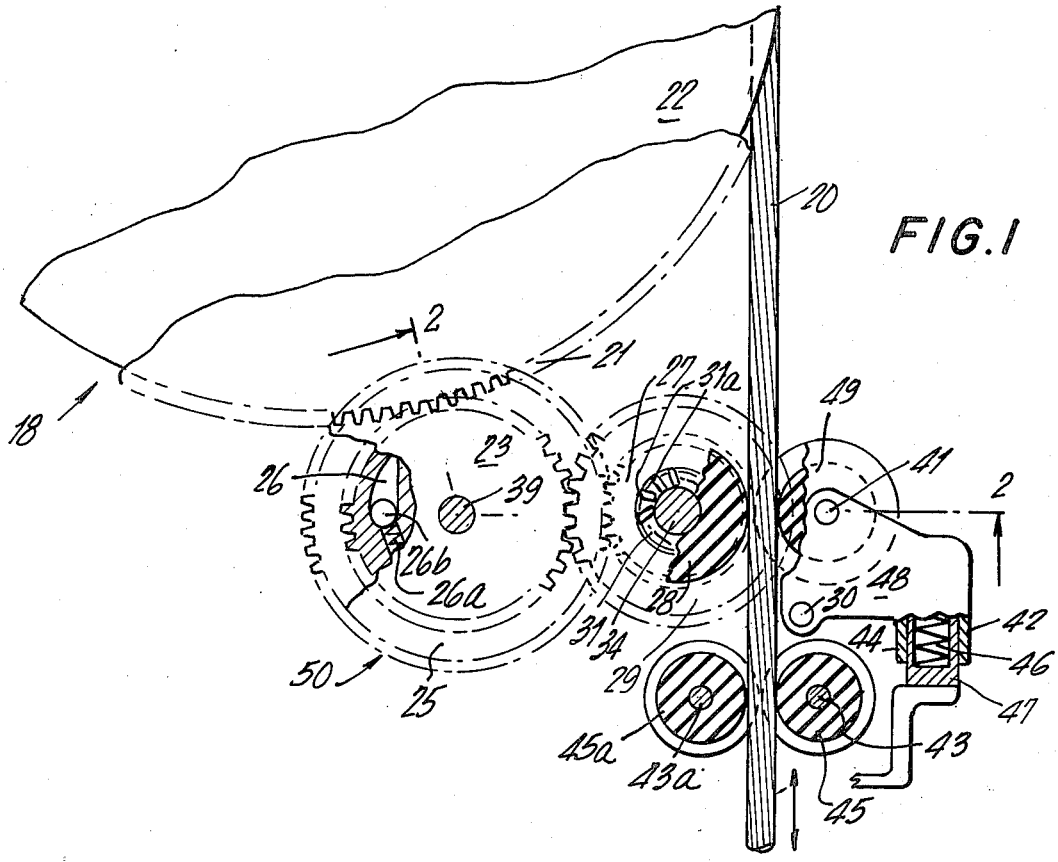
FIG. 1
FIG. 2
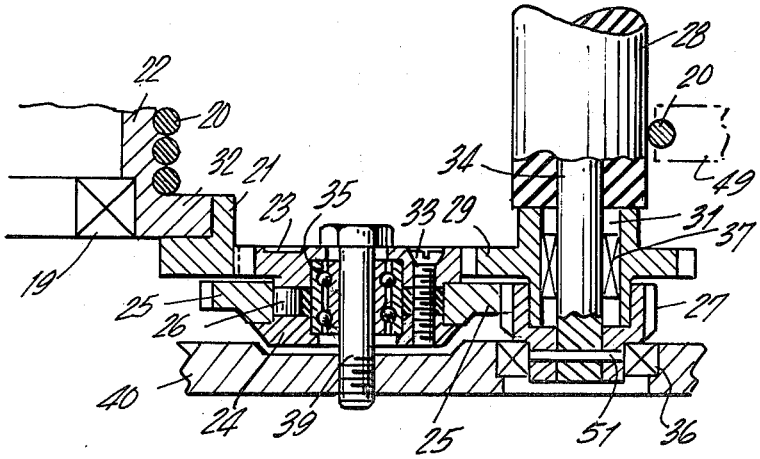

CABLE TENSIONING DEVICE

BACKGROUND OF THE INVENTION

A hoist or winch will function properly only if its cable is payed out and layed up evenly on its drum each time it is used. If tension on the cable is momentarily released, it will often unwind or tangle. Some prior art devices depend on the weight of a cable, the load on it, or the use of the frictional drag of a traction roller to overcome this problem. Others use a traction sheave driven by an independent power source.

When a cable is paid out without sufficient weight attached to its free end, it can also unwind from its drum too quickly and become tangled. Similarly, when a cable is layed up without sufficient tension at its free end, it may wind up too loosely. When a winch is used in a helicopter, for example, its load can come into sudden contact with the ground, thereby releasing the tension on the cable and causing it to tangle.

The present invention provides a means of controlling the cable of a winch or hoist to prevent it from tangling. By insuring that a suitable tension is placed on the cable at all times, whether it is being reeled in or payed out, all undesirable movement is prevented.

A feature of the present invention is the use of a drive gear train positively driven by the winch or hoist's drum through overrunning clutches which control a traction roller at all times.

Another feature of the present invention is its self-locking gear train which prevents the cable from becoming tangled while the drum is stationary.

SUMMARY OF THE INVENTION

The cable tensioning device for a winch or hoist according to the present invention comprises a traction roller driven by a gear train coupled to the cable storage drum. Two overrunning clutches in the gear train control the rotation of the traction roller. The cable is kept in constant frictional contact with the traction roller by means of a spring loaded roller.

Depending upon the direction in which the cable is moving, rotational power is transmitted from the drum through a driving gear to one of the two gear trains in the mechanism. Two overrunning clutches insure that power can be transmitted only to one of these gear trains at a time, and that neither train will move when the drum and cable are stationary.

The gear trains are designed so that the peripheral speed of the tensioning roller exceeds the linear speed of the cable when the cable is being unwound. The peripheral speed of the roller is less than the linear speed of the cable, however, when the cable is being laid up. Therefore, whichever direction the cable is moving, a constant drag is placed upon it to keep it from tangling.

DESCRIPTION OF THE DRAWING

In the accompanying drawing forming a part hereof, similar parts have been given identical reference numbers, in which drawing:

FIG. 1 is a fragmentary view in side elevation of a winch drum and cable tensioning device, partially broken away, according to the present invention.

FIG. 2 is a cross sectional fragmentary view partly in section of the embodiment of FIG. 1, taken along the line 2—2, looking in the direction of the arrows.

DETAILED DESCRIPTION

Referring to FIGS. 1 and 2, reference numeral 18 indicates a hoist or winch secured at one end to a cable 20 wound on a cylindrical drum 22. Drum 22 is journaled upon bearings 19 located directly beneath a flange 32. A driving ring gear 21, attached to flange 32 of the drum 22, is in mesh with an input gear 23 of a gear train 50. Input gear 23 is freely mounted upon a bearing 35 carried upon a bolt 39 secured to a stationary housing 40. Input gear 23 is coupled to an output gear 25 through a first overrunning clutch 26. The construction of said clutch, as shown in the present embodiment of the invention, is well known in the art and forms no part of the present invention, it being understood that any overrunning clutch may be used. Clutch 26 allows the output gear 25 to rotate only when the input gear 23 is rotating clockwise as viewed in FIG. 1.

Input gear 23 is also in mesh with a reel in gear 29, which is journaled upon shaft 34 carried at each end in bearings 37. A second overrunning clutch 31 is carried by reel in gear 29. Clutch 31 is shown as fitted with sprags 31*a*, which permit, reel in gear 29 to rotate only in a counterclockwise direction. Other types of overrunning clutches may also be used for this purpose. When reel in gear 29 is turning, it transmits rotational power from drum 22 to shaft 34 and traction roller 28.

Output gear 25 meshes with roller driving gear 27, which is fixed to shaft 34. Shaft 34 is secured to a roller driving gear 27 by a pin 51. Shaft 34 is secured to traction roller 27 and carried in bearings 36. Roller driving gear 27 also drives traction roller 28. The roller 28 is axially secured to shaft 34. Traction roller 28 may be made of a highly abrasion resistant urethane compound so that it will produce proper frictional contact with cable 20.

Frictional contact between cable 20 and the traction roller 28 is maintained by a first freely mounted roller 49 carried on stub shaft 41 and enclosed in housing 48. Said housing is pivotally mounted on pin 30. Cups 42, 44 enclosing spring 46, urge housing 48 in the direction of the cable, thereby forcing roller 49 to make good frictional contact with cable 20.

Two guide rollers, 45 and 45*a*, mounted on stub shafts 43 and 43*a*, lead the cable 20 as it is payed out or reeled in.

When the cable 20 is being paid out, input gear 23 drives output gear 25 through the first overrunning clutch 26. Output gear 25, in turn rotates roller driving gear 27, which turns traction roller 28. As cable 20 is being unwound, the traction roller 28 has a peripheral speed which exceeds the linear velocity of cable 20 as, for example by 15 to 20%. Traction roller 28, therefore, exerts a constant pull on cable 20 to prevent it from losing its tension on the drum.

When cable 20 is being reeled in, input gear 23 rotates reel in gear 29. The first overrunning clutch 26 now slips freely, preventing output gear 25 from turning. Instead, the second overrunning clutch 31, which slipped freely when the cable 20 was being paid out, engages, transmitting rotational power to shaft 34 and traction roller 28. Traction roller 28 now turns in the opposite direction with a peripheral velocity of the order of 10 to 20% less than the linear velocity of cable 20. This decreased velocity acts as a drag on cable 20 to prevent it from tangling as is laid up upon the drum.

When cable 20 is stationary, the ring driving gear and both clutches 26 and 31 which are oriented in opposite rotational directions, prevent gear train and the traction roller 28 from moving. The stationary traction roller 28, resting against the cable 20, thereby exerts a static tension on the cable 20 and prevents it from unwinding on its drum 22.

Having thus fully described the invention, what is desired to be secured and protected by Letters Patent of the United States is as follows:

1. A cable tensioning device comprising a rotatable drum, a cable secured at one end to said drum, a driving ring gear secured to the drum and rotatable therewith, a gear train operatively coupled to the driving ring gear, said gear train comprising an input gear, an output gear, a first overrunning clutch means for cable reel out coupled between the input gear and the output gear and which permits the output gear to rotate when the input gear rotates in one direction, a reel in gear in mesh with the input gear, a driving gear in mesh with the output gear, a second overrunning clutch means for cable reel in coupled between the reel in gear and the driving gear and which permits the reel in gear to rotate in only one direction to drive an elastomeric traction roller which is driven in the direction of the cable by the reel in gear and the driving gear, the elastomeric traction roller having a peripheral speed greater than the linear speed of the cable when the cable is paid out and the peripheral speed of the elastomeric traction roller being less than the linear speed of the cable when the cable is paid in.

2. A cable tensioning device according to claim 1 in which a spring loaded elastomeric roller is disposed in the path of the cable opposite the elastomeric traction roller.

3. A cable tensioning device according to claim 1 wherein the peripheral speed of the elastomeric traction roller is 15 to 20% greater than the linear speed of the cable when said cable is being paid out.

4. A cable tensioning device according to claim 1 wherein the peripheral speed of the elastomeric traction roller is 10 to 20% less than the linear speed of the cable when said cable is being laid up on said drum.

5. A cable tensioning device according to claim 1 wherein the traction roller travels in the same direction as the cable, whether the cable is being paid out or laid up and wherein the traction roller is locked when the cable is stationary.

6. A cable tensioning device according to claim 1 wherein the traction roller is made of a highly abrasion resistant urethane compound.

* * * * *